US005529301A

United States Patent [19]

Feller

[11] Patent Number: 5,529,301

[45] Date of Patent: Jun. 25, 1996

[54] SLIDE PUZZLE

[75] Inventor: Erhard Feller, Lippstadt, Germany

[73] Assignee: Klaus Langenbach, Lippstadt, Germany

[21] Appl. No.: 385,178

[22] Filed: Feb. 7, 1995

[30] Foreign Application Priority Data

Mar. 11, 1994 [DE] Germany ..... 9404965 U

[51] Int. Cl.[6] ..... A63F 9/08

[52] U.S. Cl. ..... 273/153 S

[58] Field of Search ..... 273/153 R, 157 R, 273/157 A, 153 S

[56] References Cited

U.S. PATENT DOCUMENTS

| | | | |
|---|---|---|---|
| 1,459,937 | 6/1923 | Teipel | 273/153 S |
| 1,539,738 | 5/1925 | Hutton | 273/153 S |
| 1,555,980 | 10/1925 | Johnson | 273/153 S |
| 2,779,598 | 1/1957 | Steinhardt | 273/153 S |
| 4,422,641 | 12/1983 | Collin | 273/153 S |
| 4,927,150 | 5/1990 | Monoyios | 273/153 S |
| 5,060,948 | 10/1991 | Hausner | 273/153 S |
| 5,267,732 | 12/1993 | Bowen et al. | 273/153 S |

*Primary Examiner*—Steven Wong
*Attorney, Agent, or Firm*—Burns, Doane, Swecker & Mathis

[57] ABSTRACT

A slide puzzle comprises a frame forming a rectangular playing surface on which a plurality of rectangular pieces are slidably arranged. The pieces collectively occupy less than the entire area of the playing surface, so that a free space exists to enable the pieces to be shifted. In that way, an indicia (e.g., a picture) carried by the pieces can be completed. In order to positively prevent the pieces from moving, a releasable closing member is provided, e.g., in the form of a filler piece that can be inserted into the free space, or a locking pin insertable through the frame and at least some of the pieces.

9 Claims, 2 Drawing Sheets

SLIDE PUZZLE

BACKGROUND OF THE INVENTION

The invention relates to a slide puzzle, comprising a rectangular playing surface, over which a number of rectangular sliding pieces are arranged such that the pieces can be moved due to an omitted missing piece which creates an empty space. The pieces can thus be moved to complete an indica, such as a picture or a word, portions of which are provided on the respective pieces.

The invention originates from a slide puzzle which is also known in the art as a game of skill. With games of skill of this sort, square sliding pieces arranged on a playing surface can be moved parallel to the sides of the frame. The shifting of the individual pieces is made possible by the fact that a sliding piece is omitted from the square sliding surface, so that pieces can be shifted into the free space to reposition the pieces. It is herewith possible, for example, to arrange the appropriate number of sliding pieces in the rectangular frame according to the desired size of the playing surface of the game.

The surfaces on the underneath and top sides of the individual pieces have sections of a picture, so that the individual pictures can be pieced together into a picture or word by shifting them. In this way it is conceivable, for example, to arrange numeric or alphabetic series on the surfaces which the player then can shift within the frame so as to put the numbers or letters in order, or individual pictures, similar to a puzzle, that can be pieced together into a picture.

It is to their disadvantage, in known games of this sort, that because one sliding piece is omitted, a portion of the indicia might therefore be absent. This is disruptive to the appearance of the slide puzzle. Furthermore, a looseness in the puzzle frame results due to the missing sliding piece, through which an independent loosening of the pieces results, so that the sliding pieces shift independently and so then the general character of the slide puzzle is not preserved. This results especially when, for example, the game of skill is carried in a pocket or on a key chain and therefore is affected by bumping or shaking. It is therefore the object of the invention to improve on a slide puzzle of this type as is known in the art, that the sorted illustrative character of this game is preserved after sorting, whereby the appearance of the slide puzzle as well as the practical use of the game be improved.

SUMMARY OF THE INVENTION

Part of the object is solved in accordance with the invention in that a mechanism for closing is arranged in the area of the frame, which prevents the undesired shifting of the sliding pieces. The arrangement of a closing mechanism in the area of the frame ensures that the sorted pieces will maintain their position in the frame, so that the picture or series remains in the sorted position. An unwanted shifting of the sliding pieces, for example by a change in position of the slide puzzle is thereby prevented.

It is especially advantageous that the mechanism can be either pushed into, put into, or swiveled into position on the frame. The closing mechanism therefore can be pushed into the playing surface to fasten it either in the surface region as a bolt or as an unremovable pieces on a small chain stuck in or also as a pieces arranged on an arm to swivel in.

In a particularly advantageous configuration of the invention, the mechanism is a filler piece or a locking pin. The filler piece would have a picture section for completing the picture. Based on this construction it is ensured that the picture in the frame can be completed and therefore the playing surface appears complete. If a locking pin is used, it would be insertable through a bore hole aligned in the sliding pieces in the frame to secure the sliding piece.

The frame and the sliding pieces probably have interconnecting spring strips and grooves. Based on this configuration a stable guidance of the individual piece in the rectangular space results, so that the individual sliding pieces can be easily and simply shifted among each other and on the sides of the frame.

According to a further advantageous configuration of the invention, the filler piece is situated in the corner of the picture, or rather the frame. Based on this arrangement it is possible that the sliding pieces forming in the picture are sorted for the time being in such a way that they result in a picture on the entire surface and finally the filler piece completes the picture. In this way the filler piece, in an advantageous arrangement, consists of a slidable bar mounted to the frame, which bar has interconnecting spring strips and grooves. Consequently the filler piece can be pushed in then after the last piece has been shifted to its proper position. One section of the bar can carry a section of the picture and another section could have the form and color of the frame. After the filler piece is pushed in, a closed picture surface and a surrounding closed frame surface results for the slide puzzle so that the slide puzzle appears as one complete unit. Should the slide puzzle be played with again, the filler piece is released and removed, so that an open surface within the frame is created that makes it possible to shift the rest of the sliding pieces.

In a furtherance of the invention, the filler piece, preferably a bar, is provided in the frame area with a spring locking catch. As the filler piece fastens the sliding pieces, so the filler piece is held to the frame by a spring locking catch, so that an independent loosening of the filler piece from the frame cannot occur. In a furtherance of the invention the frame, or rather the frame area is manufactured as a one-piece extruded plastic piece, whose outer border can be shaped in a preferred form. It is conceivable thereby that especially the frame region can take on various forms, as for example, the shape of an animal, telephone, ball, etc., so that in consideration of the design of the frame, different possibilities are available and whereby approximately in the center of the resulting planar form the rectangular playing area is enclosed.

BRIEF DESCRIPTION OF THE DRAWINGS

In particular an illustrative example of the invention is shown by means of the following FIGS. 1 through 5, of which.

DETAILED DESCRIPTION OF A PREFERRED EMBODIMENT OF THE INVENTION

Figure 1:
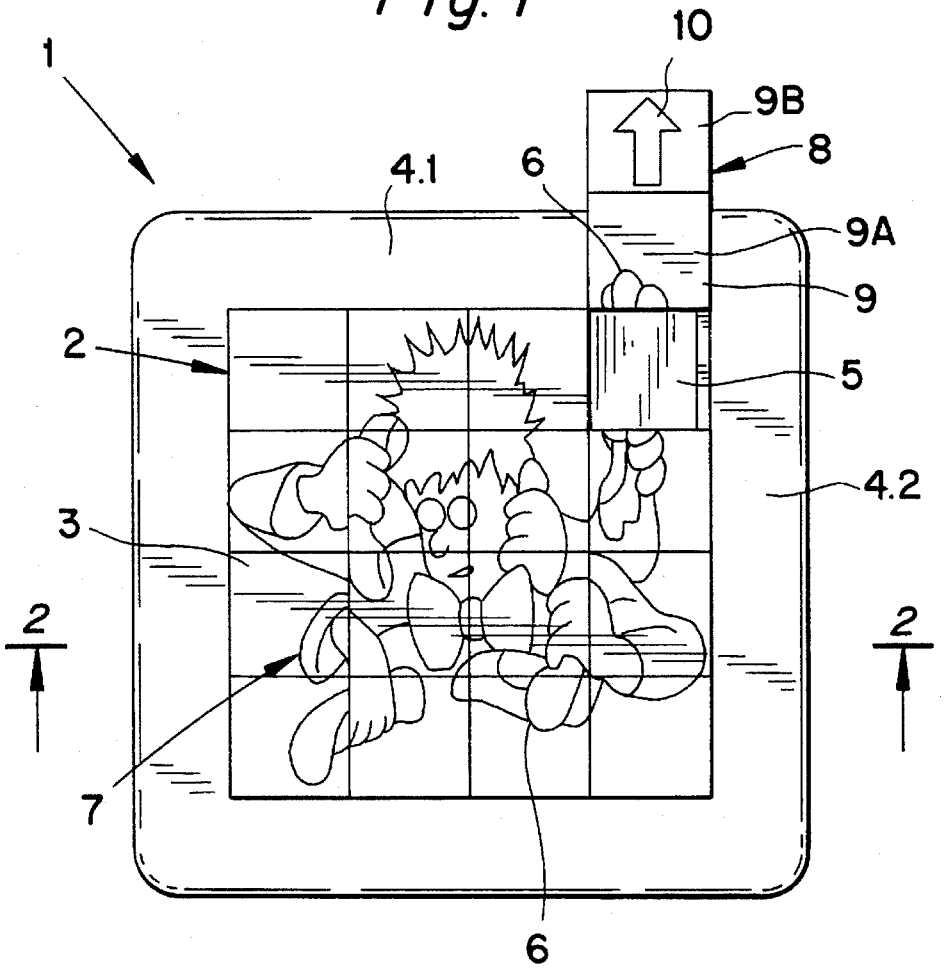
FIG. 1 shows a top view of the slide puzzle in accordance with the invention.

FIG. 1 shows a slide puzzle 1 in a top view, which comprises a rectangular frame 2, and a number of rectangular sliding pieces 3 movably mounted in the frame for being shifted parallel to respective sides 4.1, 4.2 of the frame. The shiftability of the individual sliding pieces 3 is made possible in that an area 5 is left open so that the individual sliding pieces 3, or a column of sliding pieces, can be shifted parallel to their adjacent side 4.1 or 4.2. As shown in FIG. 1, the individual surfaces of the sliding pieces 3 are printed with picture sections 6 so that the individual picture 6 can be shifted into sorted condition to properly form an indicia such as a picture 7 or a word (not shown) for example.

Figure 3:
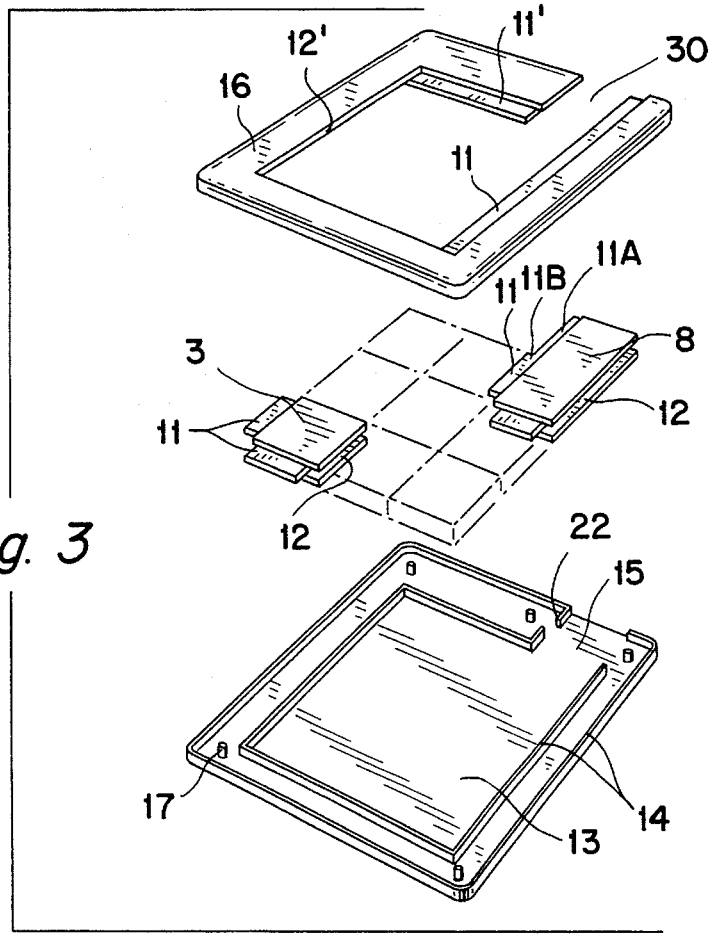
FIG. 3 shows an exploded representation of the slide puzzle in perspective.

According to the invention, in the region of the frame 2 a closing mechanism 8 is arranged, which prevents an unwanted shifting of the sliding pieces 3. Mechanism 8 can be fastened on frame 2 and comprised of a slidable closing bar to be pushed in as shown in FIGS. 1 and 3, or as a sliding piece attached to a chain (not shown) to be put in, or as a sliding piece attached to a swivelling arm (not shown) to be swiveled into frame 2. As is also shown in FIG. 1, mechanism 8 is shown as a filler piece 9 printed with a picture section 6 so that when the filler piece 9 is pushed opposite the arrow 10, the picture is completed.

Figure 4A:
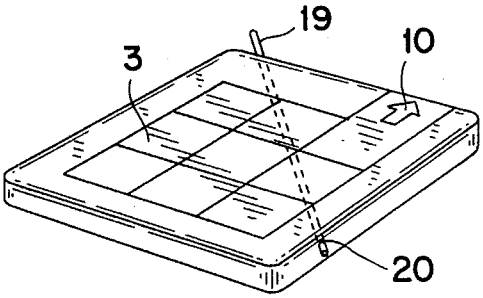
FIGS. 4A and 4B show further perspective representations of the slide puzzle in the closed (FIG. 4A) and released (FIG. 4B) positions.

According to a further variation of the invention, shown in FIG. 4A, the mechanism for closing can be a locking pin 19 for locking the movement of the sliding pieces 3. The frame 2 and the sliding pieces have aligned bore holes 20 for this purpose, through which the locking pin can be inserted. The bore holes 20 run diagonally in the sliding pieces 3 as can be seen in the figure, whereby the aligned bore hole 20 runs through the frame 2 in a corner region of the frame.

Figure 2:
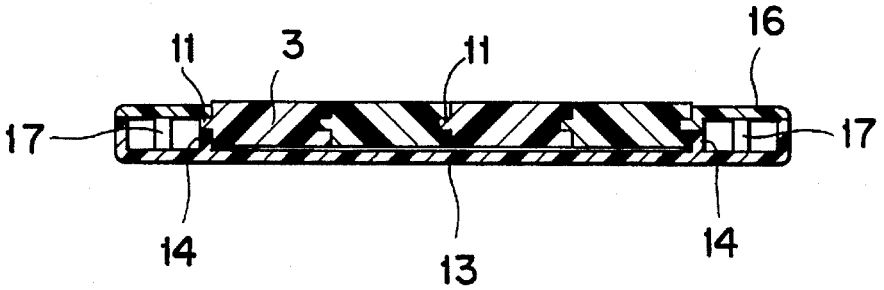
FIG. 2 shows a sectional view in accordance with a section line 2—2 in FIG. 1.

As can be seen especially in FIGS. 2 and 3, the inner side of frame 2 and the sliding pieces 3 have interconnecting spring strips 11 and grooves 12. In a corner of the picture 7 (or of the frame 2) the filler piece 9 is situated . The filler piece 9 itself consists of a bar projecting through the frame 2, and which also has an interconnecting spring strip 11 and a groove 12 on the sides along its length and width.

The frame 2 includes a base plate 13, with a ridge 14 formed on the outer edge of the base plate 13. The ridge 14 projects from the base surface of the base plate 13. In a corner area of the framing ridge 14, there is an opening 15 or rather an interruption of the ridge 14, through which the filler piece 9 can be pushed. Thereby the filler piece 9 is made in such a way that its spring strip 11 is recessed at 11A to define a shoulder 11B that abuts a projecting piece 22 of the ridge 14. Based on this arrangement, it is ensured that the filler piece 9 is locked in without being able to be lost.

Figure 5:
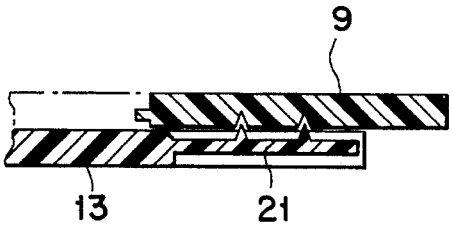
FIG. 5 shows a cross section of a locking catch.

On the base plate 13 a G-shaped frame cover 16 surrounding the sliding pieces 3 is attached in accordance with the shaped ridge 14. The frame cover 16 also has spring strips 11' and grooves 12' so that the individual sliding pieces 3 can be slid inside this G-shaped frame cover, whereby the region of the opening 30 is closed by filler piece 9. For a stable holding of the frame cover 16 to the base plate 13, notch elements 17 are provided in the area of the formed ridge 14, so that the laying G-shaped frame cover 16 with the included sliding pieces 3 can be bonded to the base plate 13 with adhesive. The detailed drawing of FIG. 5 shows a spring catch 21 that only allows the fill piece 9 to be shifted against the notch's resistance.

Figure 4B:
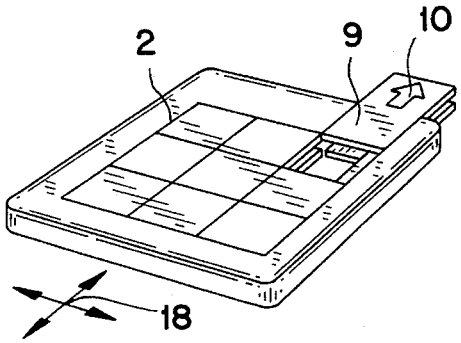

In FIG. 4A the slide puzzle 1 is portrayed in perspective in the closed or locked position. FIG. 4B shows the slide puzzle in the released position, whereby the individual sliding pieces 3 or columns can be moved in accordance with the arrows 18. In an advantageous way the filler piece 9, as for example can also be seen in FIG. 1, has a portion 6 of the picture formed on one of its sections and on the other section 9B has the form and color of the frame 2 so that the filler piece 9 completes the entire picture of the slide puzzle 1 in the closed position. So that the filler piece 9 does not dislodge itself, the filler piece 9, shown as a bar, is provided with a spring catch 21 in the frame region 2.

Instead of being formed of two pieces, the frame 2 could be manufactured as a one piece extruded plastic piece, whereby the outline of the frame 2 can be formed in a preferred shape so that the sliding surface, portrayed here as rectangular, can be surrounded by variously shaped surfaces. So, for example, the rectangular sliding surface can be surrounded by a round, triangular, oval or heart shaped form. Other shapes such as a locomotive, telephone motif, etc. are also representable without further ado in this invention.

Although the present invention has been described in connection with a preferred embodiment thereof, it will be appreciated by those skilled in that art that additions, modifications, substitutions and deletions not specifically described may be made without departing from the spirit and scope of the invention as defined in the appended claims.

What is claimed is:

1. A slide puzzle comprising a frame forming a rectangular playing surface, and a number of rectangular sliding pieces arranged to travel over the playing surface and containing respective sections of an indicia, the sliding pieces collectively occupying less than the entire area of the playing surface so that there remains a rectangular free space of the same size as an individual sliding piece for permitting the sliding pieces to be shifted relative to one another in order to properly form the indicia, and a releasable closing mechanism for positively preventing relative movement between the sliding pieces, the closing mechanism comprising a filler member insertable into the free space, the filler member containing a portion of the indicia for completing the indicia, the filler member being larger than the free space so that a first section of the filler member carries the portion of the indicia, and a second section of the filler member is of the same color as the adjacent part of the frame.

2. The slide puzzle according to claim 1, wherein the filler member is mounted slidably on the frame.

3. The slide puzzle according to claim 2, further including a catch for yieldably resisting movement of the filler member.

4. The slide puzzle according to claim 1, wherein each sliding piece has grooves and spring strips, the spring strips being insertable into the grooves of another sliding piece.

5. The slide puzzle according to claim 4, wherein the closing mechanism comprises a sliding filler member insertable into the free space, the filler member including a spring strip insertable into a groove of the frame.

6. The slide puzzle according to claim 1, wherein the closing member comprises a locking pin insertable into a plurality of the sliding pieces.

7. A slide puzzle comprising a frame forming a rectangular playing surface, and a number of rectangular sliding pieces arranged to travel over the playing surface and containing respective sections of an indicia, the sliding pieces collectively occupying less than the entire area of the playing surface so that there remains a rectangular free space of the same size as an individual sliding piece for permitting the sliding pieces to be shifted relative to one another in order to properly form the indicia, a releasable closing mechanism for positively preventing relative movement between the sliding pieces, the closing mechanism comprising a filler member insertable into the free space, the filler member being mounted slidably on the frame, and a catch provided for yieldably resisting movement of the filler member.

8. A slide puzzle comprising a frame forming a rectangular playing surface, and a number of rectangular sliding pieces arranged to travel over the playing surface and containing respective sections of an indicia, the sliding pieces collectively occupying less than the entire area of the playing surface so that there remains a rectangular free space of the same size as an individual sliding piece for permitting the sliding pieces to be shifted relative to one another in order to properly form the indicia, and a releasable locking pin insertable into a plurality of the sliding pieces for positively preventing relative movement between the sliding pieces.

9. The slide puzzle according to claim 8, wherein the frame includes aligned holes, and the sliding pieces include holes arranged so that the hole of at least two sliding pieces can be placed into alignment with the holes of the frame for receiving the locking pin.

* * * * *